US005248002A

United States Patent [19]

Williams

[11] Patent Number: 5,248,002

[45] Date of Patent: Sep. 28, 1993

[54] GROUND ROD INSTALLATION METHOD

[76] Inventor: Tunney E. Williams, 126 Tanglewood Dr., Lynchburg, Va. 24502

[21] Appl. No.: 984,494

[22] Filed: Dec. 2, 1992

[51] Int. Cl.[5] ..... E02D 7/04; B25D 1/00

[52] U.S. Cl. ..... 173/1; 173/90; 405/232; 81/20

[58] Field of Search ..... 173/1, 90, 91, 128; 405/231, 232; 81/27, 26, 20, 21

[56] References Cited

U.S. PATENT DOCUMENTS

| | | | |
|---|---|---|---|
| 1,582,305 | 4/1926 | Reichling | 81/20 |
| 1,769,169 | 7/1930 | Thornley | 405/232 |
| 2,225,765 | 12/1940 | Brice | 173/126 |
| 3,117,378 | 1/1964 | Bowen | 33/293 |
| 3,519,087 | 7/1970 | Santi | 173/91 |
| 3,786,847 | 1/1974 | Schera, Jr. | 81/27 |
| 4,298,075 | 11/1981 | Sweeney | 405/232 |
| 4,315,551 | 2/1982 | Iannone | 173/128 |
| 4,327,787 | 5/1982 | Loratto | 173/91 |
| 5,174,388 | 12/1992 | Williams et al. | 173/1 |

FOREIGN PATENT DOCUMENTS

| | | | |
|---|---|---|---|
| 999735 | 7/1965 | United Kingdom | 173/90 |

*Primary Examiner*—Scott Smith

*Attorney, Agent, or Firm*—Nixon & Vanderhye

[57] ABSTRACT

The tool includes a handle having a bore opening at its lower end and a hammer head at its opposite end. A weight is removably secured to the hammer head and has an aperture in one end. In use, the tool is applied to a ground rod such that the upper end of the rod is received within the bore of the handle. By repeated raising and lowering of the tool, as slide hammering action occurs driving the rod into the ground. After this initial penetration into the ground, the tool is removed from the rod and the weight is removed from the tool and placed on the end of the rod to provide a large impact surface. The tool may now be used as a sledge hammer striking the enlarged surface of the weight on the rod end to drive the rod into final position.

4 Claims, 3 Drawing Sheets

FIG. 1
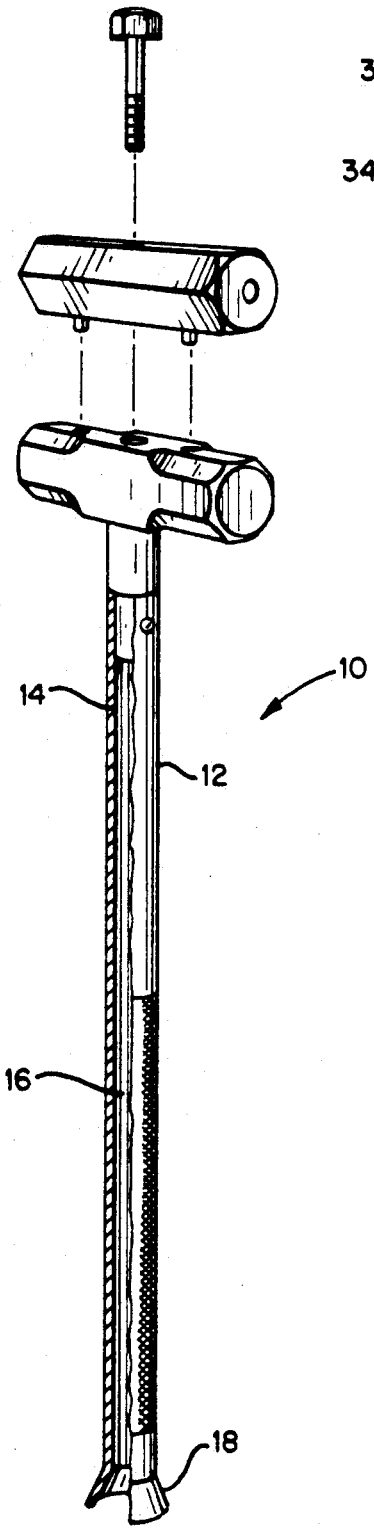
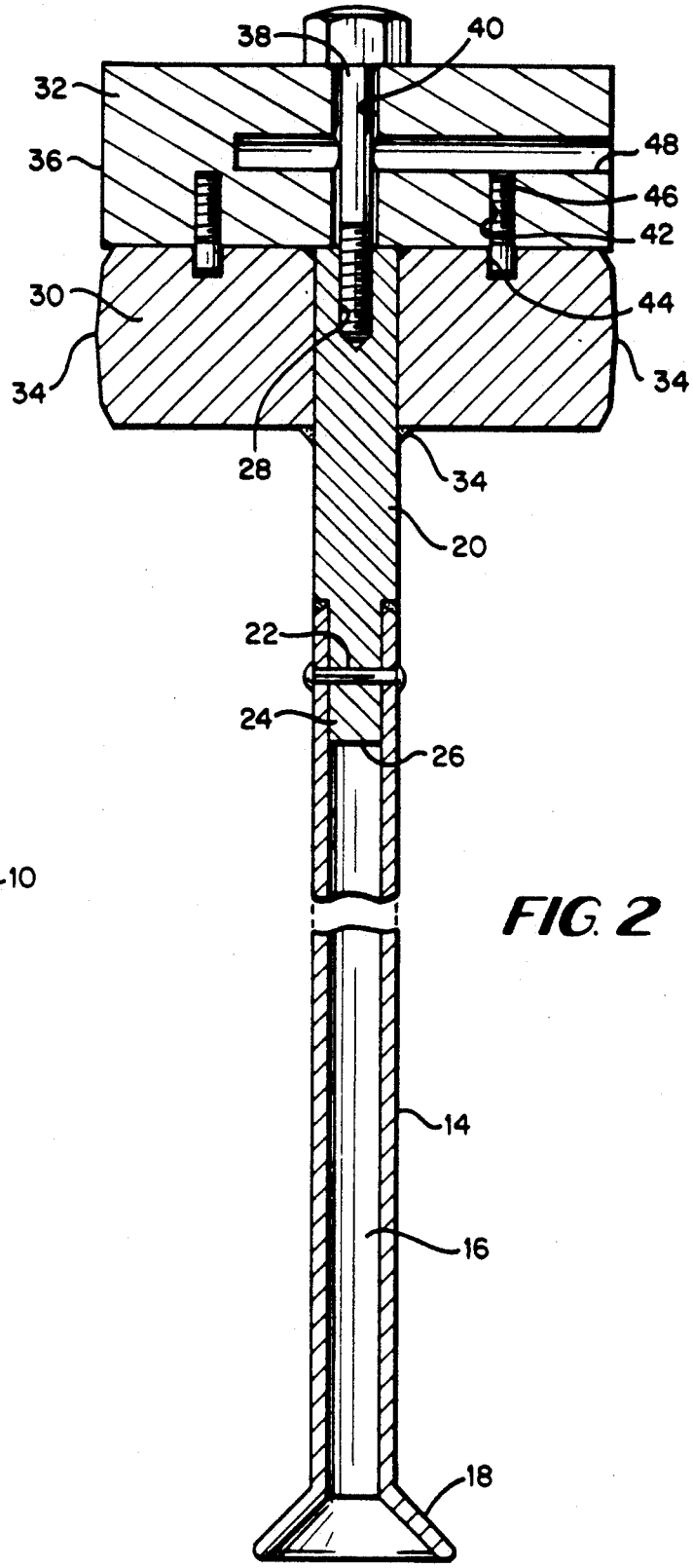
FIG. 2

FIG. 3
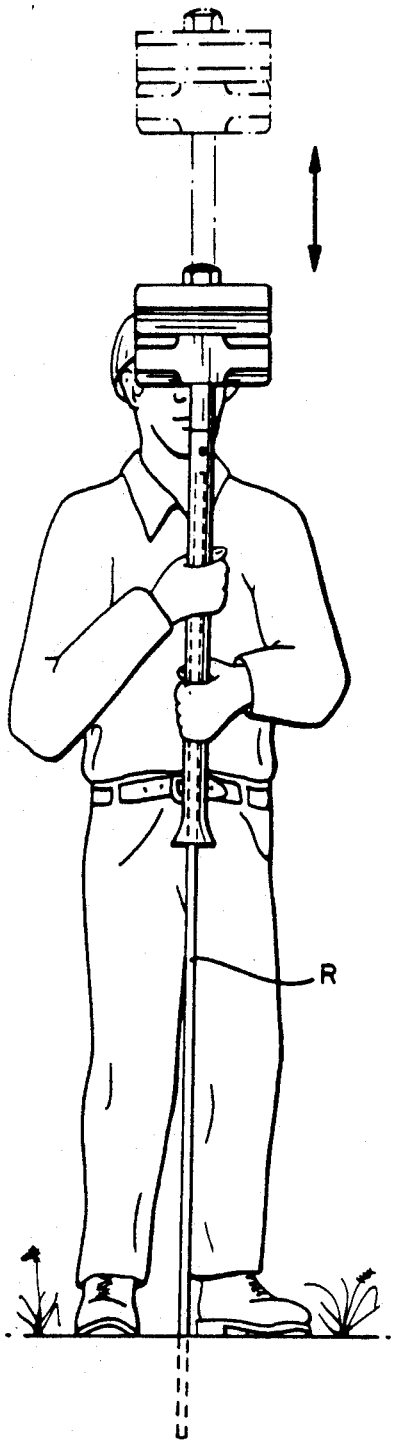
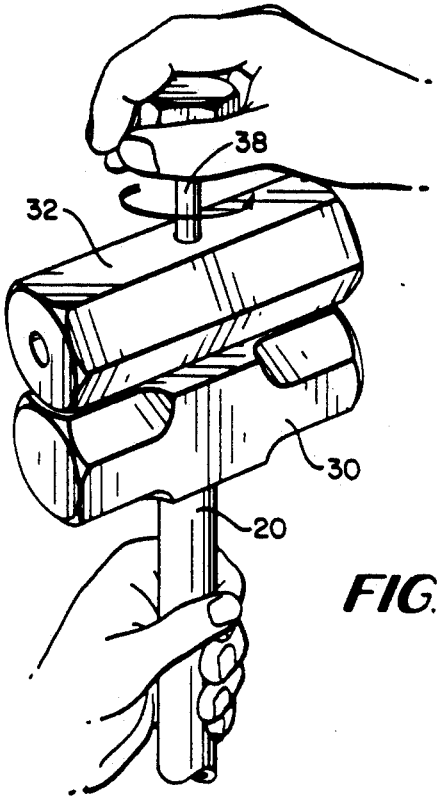
FIG. 4
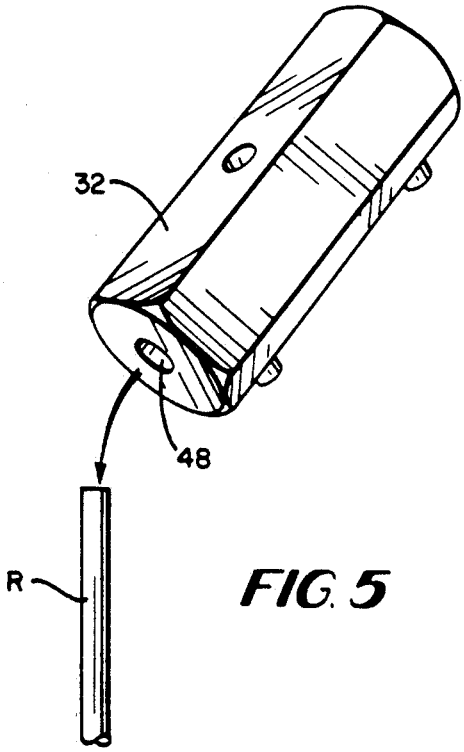
FIG. 5

GROUND ROD INSTALLATION METHOD

BACKGROUND AND SUMMARY OF THE INVENTION

The present invention relates to the installation of ground rods for grounding equipment associated with power distribution systems and particularly relates to a ground rod installation hammer and method of using the hammer.

Ground rods are typically used by utility companies to ground equipment associated with power distribution systems, e.g., high tension towers and light poles, so as to prevent damage caused by lightning, electrical surges, stray voltages and the like. Ground rods are typically formed of highly conductive material and driven into the ground to predetermined depths. Conventionally, the ground rods are driven into the ground by impacting devices, such as hammers. In my prior application, Ser. No. 757206 filed Sep. 10, 1991, now U.S. Pat. No. 5,174,388, issued Dec. 29, 1992, there is disclosed a mechanism for guiding and facilitating the insertion of the ground rod into the ground. In many applications, however, sledge hammers are often utilized as the means to drive the rod into the ground.

As a means for driving the rods into the ground, sledge hammers leave a lot to be desired. For example, typically an individual will hold the rod while another individual swings a sledge hammer intending the hammer head to impact on the upper end of the rod to drive the rod into the ground. Frequently, the individual swinging the sledge hammer misses the upper end of the rod and the sledge hammer impacts against the arm or hand of the individual holding the rod. Also, there is a substantial danger of striking the rod end with the sledge hammer off center. This may not only bend the rod but can deflect the sledge hammer toward or into the individual holding the rod. Thus, there is the very substantial danger of injury to individuals assisting in driving the rods into the ground when a sledge hammer is used. Moreover, the weight of the sledge hammer and, hence, its impact on the rod, is limited by the ability and strength of the individual when swinging the sledge hammer to swing the hammer accurately and impact the upper end of the rod. Too much weight inhibits the individual from swinging the sledge hammer accurately, while too little weight requires a substantial number of repetitive impacts of the hammer on the rod to drive the rod into the ground. The present invention avoids and overcomes many of these problems when a sledge hammer is used to manually drive the rod into the ground.

According to the present invention, there is provided a tool in the nature of a sledge hammer, but having various modifications and adaptations to facilitate the impacting a ground rod with substantial weight without bending or missing the rod or only partially impacting the rod when it is being driven. Additionally, the present invention provides a tool which, when used as a sledge hammer, does not require another individual to hold the rod. It also improves the accuracy of the impact on the rod when swinging the tool as a sledge hammer and minimizes any tendency of the tool to be deflected when the rod is struck slightly off-center.

For this purpose, the tool of the present invention comprises a handle having a sleeve defining a bore opening through the handle at one end for receiving the upper end of a rod to be driven into the ground. The end of the handle about the bore opening is flared outwardly to prevent the operator's hand from slipping off the handle when using the tool as a slide hammer and as a sledge hammer, as well as to facilitate reception of the upper end of the rod within the bore. The handle includes a sleeve defining the bore and a solid shank secured to the end of the sleeve opposite the handle opening, the end of the shank serving as a striking surface as described hereinafter. The opposite end of the handle mounts a hammer head and a weight. Preferably, the hammer head and weight are generally of similar configuration in length, width and height with each having a generally hexagonally cross-sectional shape. The hammer head is secured to the opposite end of the handle in any convenient manner, similarly as sledge hammer heads are typically secured to handles, for example, by welding.

The weight is removably mounted on the tool adjacent the hammer head end of the tool. Particularly, the shank handle has an internally threaded bore. The weight also includes a bore for receiving a bolt whereby the bolt may be threaded into the shank of the handle to removably mount the weight to the tool. To prevent the weight from rotating about the bolt and relative to the adjacent hammer head, one or more pins are disposed in registering apertures in the weight and hammer head to maintain the weight and the hammer head aligned one with the other.

An important feature of the present invention, as will become clear from the following description, resides in the provision of a longitudinally extending aperture formed in the weight opening through an end face of the weight. The diameter of the aperture is such that the weight, when removed from the tool, can be disposed on the rod end with the rod end being received within the aperture. In this manner, the opposite end face of the weight may serve as a striking surface for the tool when used as a sledge hammer.

In use, the tool, with the weight secured to the hammer head end of the tool, is applied over the rod to be inserted into the ground such that the upper end of the rod is received in the handle bore. By repeatedly raising and lowering the tool and repeatedly striking the upper end of the rod with the impact surface of the shank within the bore of the handle, the rod may be driven into the ground. The handle sleeve defining the bore provides a guide for the tool during this slide hammering action. When the rod has been driven into the ground as deep as the handle permits, and greater impact forces are necessary to further drive the rod into the ground, the tool is lifted and removed from the rod. The bolt securing the weight to the tool head is unthreaded and the weight is removed from the tool. The weight is then applied to the upper end of the ground rod by inserting the weight over the rod end, i.e., the rod end being received within the aperture of the weight. The opposite end face of the weight then serves upwardly facing as an impact surface carried by the rod. The tool can then be employed as a sledge hammer and the rod driven into final engagement into the ground by impacting the hammer head against the end face of the weight carried by the rod.

It will be appreciated from the foregoing description that the slide hammering action impact force initially applied to the rod when the rod lies within the sleeve does not require another individual to hold the rod. The handle sleeve serves as a guide for this slide hammering action. Additionally, greater impact is provided on the rod by the combined weight of the hammer head and weight attached thereto during this slide hammering action than might otherwise occur by swinging a conventional sledge hammer. Further, when a sledge hammer action is necessary, the end face of the weight serves as an additional and enlarged head against which the head of the tool may be impacted. Thus, the sledge hammer can be swung with greater accuracy, and with less danger of the rod bending or the tool deflecting upon impact.

In a preferred embodiment it is a tool for installing a rod into the ground comprising a handle having a bore opening at one of the handle for receiving the rod; a hammer head secured to said handle adjacent its opposite end; a weight carried by said tool adjacent said opposite end of said handle and said hammer head such that, upon disposition of the tool over an end of the rod and reception of the end of the rod within said bore, the tool may be raised and lowered along the rod to hammer the rod in the ground; and means for removably mounting said weight on said tool whereby, upon removal of the weight, the tool may be swung as a sledge hammer to further drive the rod into the ground.

In a further preferred embodiment, it is a method of driving a rod into the ground using a tool having an elongated handle with a bore opening at one end of the handle and a head and removable weight adjacent the opposite end of the handle, comprising the steps of disposing the tool over the rod with the end of the rod received within the bore of the handle; repeatedly raising and lowering the tool with the weight attached to drive the rod into the ground; thereafter, removing the tool from the rod; removing the weight from the tool; disposing the weight on the rod with the end of the rod received within an aperture formed on the weight; and striking the weight with the hammer head to further drive the rod into the ground.

Accordingly, it is primary object of the present invention to provide a novel and improved ground rod installation tool and method of use which minimizes or eliminates many of the dangers inherent in the use of a sledge hammer while facilitating insertion of the rod into the ground.

BRIEF DESCRIPTION OF THE DRAWINGS

FIG. 1 is an exploded perspective view with parts broken out and in cross-section of a ground rod installation tool according to the present invention;

FIG. 2 is an enlarged cross-sectional view thereof;

FIG. 3 is a schematic illustration of the tool as it is employed when slide hammering a rod into the ground;

FIG. 4 is a fragmentary schematic perspective illustration of the manner of removing the weight from the end of the tool;

FIG. 5 is a schematic view of the manner of deploying the weight on the end of the rod.

DETAILED DESCRIPTION OF THE DRAWINGS

Figure 6:
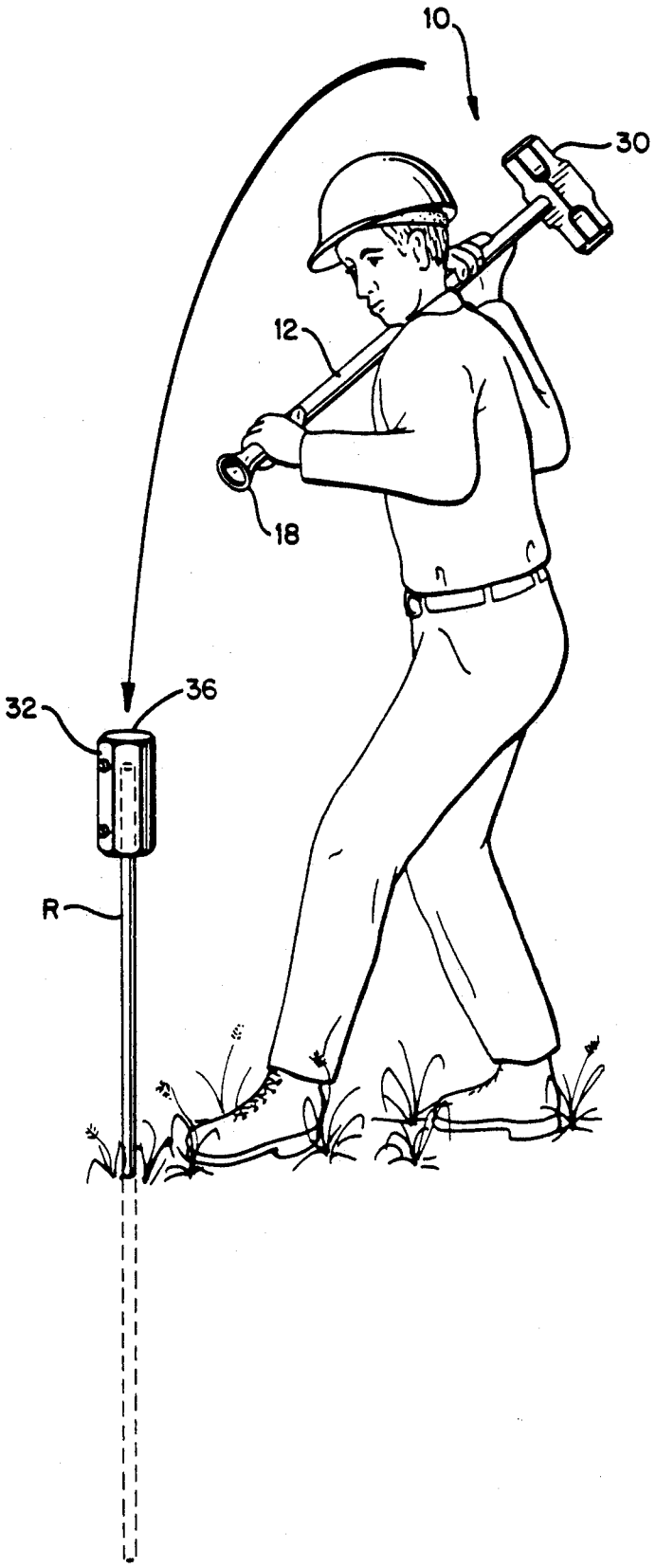
FIG. 6 is a schematic representation of the rod being driven into the ground by the tool hereof using a sledge hammer action.

Referring now to the drawings, particularly to FIG. 1, there is illustrated a tool according to the present invention generally designated 10. Tool 10 comprises a handle 12 comprised of a sleeve 14 defining a bore 16 opening at the lower end of handle 12. The handle opening is defined by a radially outwardly flared lip 18 to prevent the operator's hand from slipping over the end of the handle when used as a slide hammer, to facilitate reception of the ground rod within the bore 16 of handle 12 and to facilitate gripping the handle when the tool is used as a sledge hammer, as described hereinafter. The upper portion of handle 12 comprises a shank or solid shaft 20 suitably secured to the sleeve 14, for example, by a pin 22 passing through a reduced diameter portion 24 of shank 10 and the walls of sleeve 12. The lower end 26 of shank 20 serves as an impact surface as will become clear from the ensuing description. The upper end of shank 20 is provided with an internally threaded bore 28.

Tool 10 also includes a hammer head 30 and a weight 32. Head 30 is suitably secured adjacent the upper end of handle 10, for example, by welding 34 to shank 20, the shank 20 passing through a central aperture in head 30. As best illustrated in FIG. 4, both the head 30 and weight 32 have length and width dimensions in a plane normal to the longitudinal extent of handle 12 and are preferably hexagonal in cross section. Opposite ends of the head 30 form impact surfaces 34 while one end 36 of weight 32 forms an impact surface.

Referring back to FIG. 2, weight 32 is removably secured to tool 10 by means of a bolt 38 which passes through a central bore 40 in weight 32. Bolt 38 screw threads into the internally threaded bore 28 in shank 20. To prevent rotation of the head 30 and weight 32, relative to one another, registering bore holes 42 and 44 are formed in the weight 32 and head 30, respectively, for receiving a pin 46. Preferably, the pins 46 may be threadably secured in one or the other bore holes 42 and 44. Additionally, two such registering openings are preferably provided, on opposite sides of the bolt 38, although one would suffice. For reasons discussed hereinafter, the weight 32 also includes an axially extending aperture 48 which opens through the end face of weight 32 opposite impact surface 36. The diameter of aperture 48 is sufficiently large as to be capable of receiving the end of a ground rod R.

In use, the rod is initially located for insertion into the ground. The tool is then elevated over the rod R such that the upper end of the rod may be received in the bore 16 of handle 12. The flared tip 18 facilitates reception of the rod in the bore 16. By repeatedly raising and lowering the tool 10 as illustrated in FIG. 3 in the direction of the arrows, the impact surface 26 is periodically impacted against the upper end of the rod within sleeve 14. This slide hammering action thus drives rod R into the ground. It will be appreciated that there is no swinging action or necessity to hold the rod R in this initial driving phase, the sleeve itself serves as a guide for holding the rod and directing the impact surface 26 against the upper end of the rod. Also, the flare 18 signals the operator that his hand is close to the handle and, thus, in effect warns him against slipping his hand further down the handle or across the handle end.

When the rod can no longer be driven in this fashion and the rod requires further penetration into the ground, the tool 10 is removed from the upper end of the rod. Bolt 38 is unthreaded and weight 32 is removed from the tool. Once removed, weight 32 can be placed over the end of rod R. Particularly, the aperture 48 is slipped over the end of rod R such that the weight 32 tops the exposed end of the rod and presents an impact surface 36 (FIG. 6) to the individual driving the rod into the ground. The impact surface 36 thus is substantially larger in diameter than the diameter of rod R and presents a large surface area to the individual swinging the sledge hammer. This greatly enhances the accuracy of the sledge hammer when swung such that by repeatedly impacting hammer head 30 against impact surface 36 of weight 32 on the upper end of the rod, the rod can be driven finally into the ground. The flare 18 also provides a safety grip on the handle end when the tool is used as a sledge hammer.

The tool can be readily reassembled by locating the pins 46 in the respective apertures of the weight and applying the weight to the hammer head with the pins being received in the registering apertures of the hammer head. The bolt 38 may then be passed through the central aperture 40 and screw unthreaded into shank 20 to finally secure the weight to the tool.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of driving a rod into the ground using a tool having an elongated handle with a bore opening at one end of the handle and a hammer head and removable weight adjacent the opposite end of the handle, comprising the steps of disposing the tool over the rod with the end of the rod received within the bore of the handle;

repeatedly raising and lowering the tool with the weight attached to drive the rod into the ground;

thereafter, removing the tool from the rod;

removing the weight from the tool;

disposing the weight on the rod with the end of the rod received within an aperture formed on the weight; and striking the weight with the hammer head to further drive the rod into the ground.

2. A method as in claim 1 including the step of reattaching the weight to the tool.

3. A method of driving a rod into the ground using a tool having an elongated handle with a bore opening at one end of the handle and a hammer head and removable weight adjacent the opposite end of the handle, comprising the steps of disposing the tool over the rod with the end of the rod received within the bore of the handle;

repeatedly raising and lowering the tool with the weight attached to drive the rod into the ground;

thereafter, removing the tool from the rod;

removing the weight from the tool;

providing an impact surface on the end of the rod enlarged relative to the rod end; and striking the enlarged impact surface with the hammer head to further drive the rod into the ground.

4. A method as in claim 3 including the step of reattaching the weight to the tool.

* * * * *